US007896667B2

(12) United States Patent
Qing

(10) Patent No.: US 7,896,667 B2
(45) Date of Patent: Mar. 1, 2011

(54) LATCHING ELEMENT AND METHOD OF MANUFACTURING THE SAME

(75) Inventor: Zheng-Dong Qing, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 12/542,038

(22) Filed: Aug. 17, 2009

(65) Prior Publication Data

US 2010/0055965 A1 Mar. 4, 2010

(30) Foreign Application Priority Data

Aug. 26, 2008 (CN) ..... 2008 1 0304210

(51) Int. Cl.
*H01R 13/44* (2006.01)

(52) U.S. Cl. ..... 439/142

(58) Field of Classification Search ..... 439/138, 439/139, 142, 137
See application file for complete search history.

(56) References Cited

U.S. PATENT DOCUMENTS 7,077,670 B2 * 7/2006 Suwa et al. ..... 439/138
2006/0046542 A1 * 3/2006 Obara et al. ..... 439/135

* cited by examiner

*Primary Examiner*—Khiem Nguyen
(74) *Attorney, Agent, or Firm*—Steven M. Reiss

(57) ABSTRACT

A latching element includes a main section having a first end and a second end opposite thereto, a connecting portion formed on the edge of the first end, a locking portion formed on the second end; and a shaft spaced from the main section. The present disclosure also discloses a method of manufacturing the latching element and a portable electronic device having the latching element.

11 Claims, 11 Drawing Sheets

LATCHING ELEMENT AND METHOD OF MANUFACTURING THE SAME

BACKGROUND

Technical Field

The present disclosure generally relates to latching elements, particularly, to a latching element for a chip card holder and a method of manufacturing the latching element.

With the development of wireless communication and information processing technologies, portable electronic devices such as mobile phones are now in widespread use. These electronic devices enable consumers to enjoy high-tech services almost anytime and anywhere. Surface contact cards having special circuits are widely used in portable electronic devices to enhance and personalize the functions of the portable electronic devices. For example, a subscriber identity module (SIM) card can be placed in a mobile phone and holds data to automatically activate the mobile phone into which it is entered. The SIM cards make it easy to switch to a new phone by simply removing the SIM card from one mobile phone and inserting into another mobile phone.

Referring to FIGS. 10 and 11, a typical card holder 600 for mobile phone includes a receiving tray 61, a cover 63 and a pivot shaft 65. The receiving tray 61 is configured for carrying a chip card 700 therein. The receiving tray 61 includes a bottom plate 611 and a plurality of flanges 6111 perpendicularly extending from an edge of bottom plate 611. The flanges 6111 with the bottom plate 611 cooperatively surround a receiving space 613. The chip card 700 is received in the receiving space 613. A barrel 615 is formed at one side of the bottom plate 611. The cover 63 includes a main section 631 for covering the receiving space 613. One side of the cover 63 forms two spaced mounting portions 633. The distance between the two mounting portions 633 is substantially equal to the length of the barrel 615. The other side of the cover 63 forms a locking portion 635. The locking portion 635 extends upward from the edge of the main section 631. The pivot shaft 65 is substantially a cylindrical rod, and is used for passing through the barrel 615 and the two spaced mounting portions 633 to rotatably connect the cover 63 to the receiving tray 61.

However, the pivot shaft 65 and the barrel 615 have to be manufactured separately, and the pivot shaft 65 has to pass through the barrel 615 and the two spaced mounting portions 633 during assembling. The assembly process of the chip card holder 600 is complicated, which inevitable increases cost.

Therefore, there is room for improvement within the art.

BRIEF DESCRIPTION OF THE DRAWINGS

Many aspects of the latching element and the method of manufacturing the same can be better understood with reference to the following drawings. The components in the drawings are not necessarily drawn to scale, the emphasis instead being placed upon clearly illustrating the principles of the latching element and the method of making the same. Moreover, in the drawings, like reference numerals designate corresponding parts throughout the several views.

DETAILED DESCRIPTION

The present latching element for chip card holder is suitable for portable electronic devices, such as mobile phones, personal digital assistants (PDAs), portable electronic games, etc. The chip card holder can be used for holding surface contact cards such as SIM cards, compact flash cards (CFs), multimedia cards (MMCs), etc.

Figure 1:
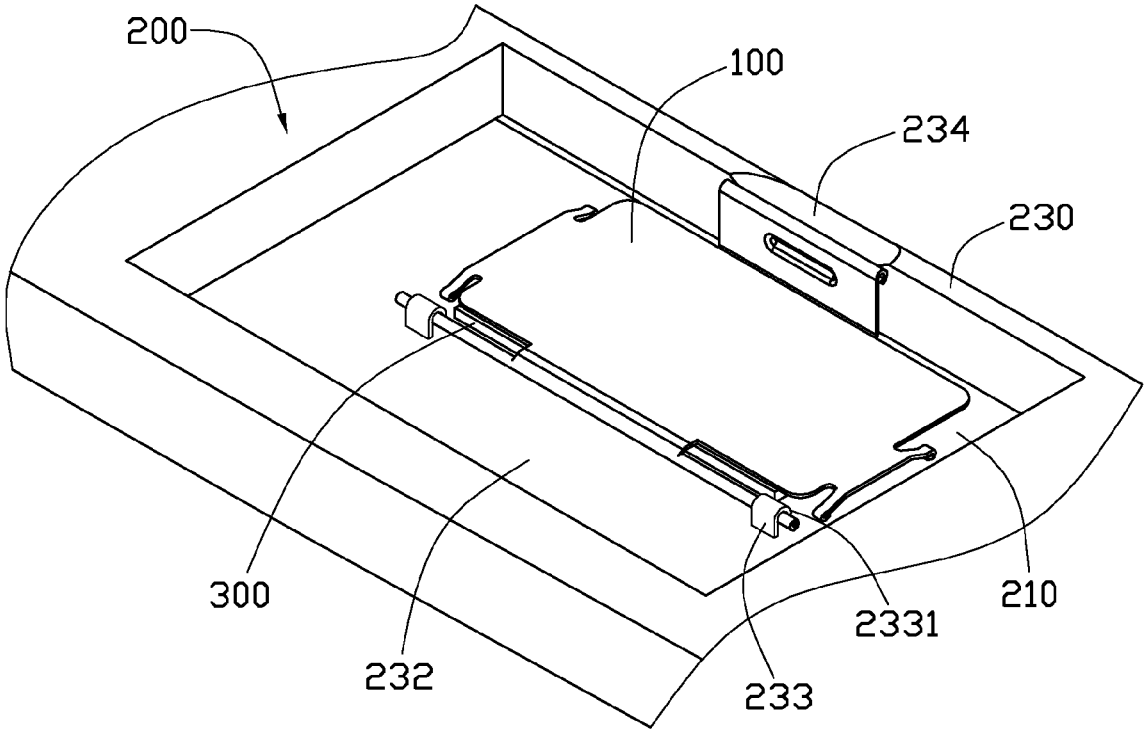
FIG. 1 is an assembled view of a latching element incorporated into a portable electronic device.

FIG. 1 shows a latching element 100 with a SIM card 300 incorporated in a mobile phone or portable electronic device. The mobile phone and the SIM card 300 are exemplary applications for the purposes of describing details of the latching element 100 of the exemplary embodiment. The mobile phone has a main body 200. The main body 200 defines a rectangular cavity 210 cooperatively surrounded by four sidewalls 230 and a bottom surface 232. Two mounting portions 233 extend upward from the bottom surface 232. Each mounting portion 233 defines a shaft hole 2331 and an opening 2333 communicating with the shaft hole 2331. The two mounting portions 233 are made of metal or plastic. A portion of one of the sidewalls 230 defines an arcuate surface 234.

Figure 2:
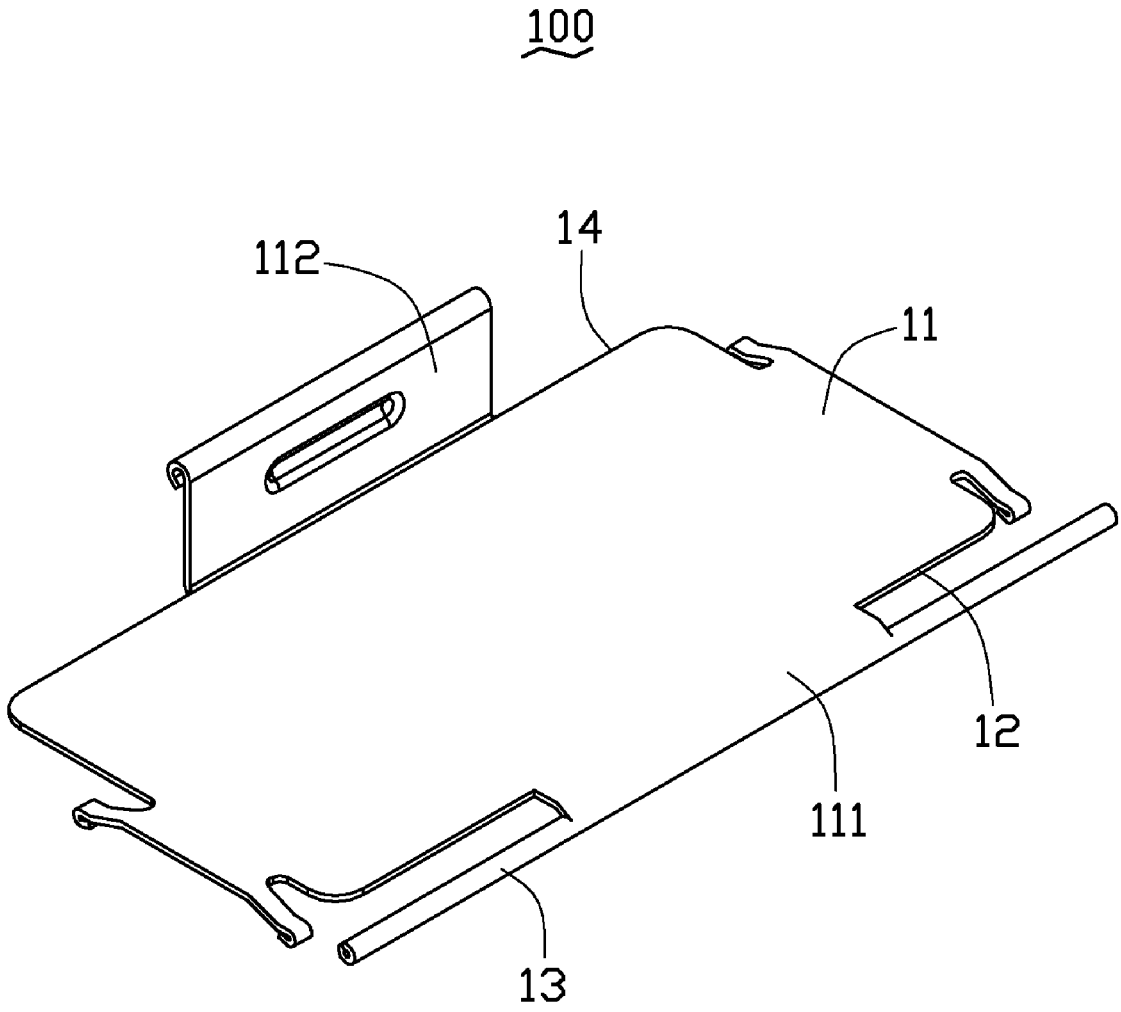
FIG. 2 is an enlarged, isometric view of the latching element shown in FIG. 1.

Referring to FIG. 2, the latching element 100 is configured for retaining the SIM card 300 in the cavity 210. The latching element 100 is made of metal, and includes a main section 11. The main section 11 has a first end 12 and a second end 14 opposite to the first end 12. The main section 11 further defines a connecting portion 111 at the edge of the first end 12 of the main section 11, and a shaft 13 forms on the edge of the connecting portion 111. The shaft 13 is integrally formed by reel-stretching; therefore, the cylindrical portion of the shaft 13 is hollow. The second end 14 has a locking portion 112 formed therefrom. The locking portion 112 perpendicularly extends from the edge of the second end 14 of the main section 11. The locking portion 112 is integrally formed with the main section 11 by punching.

When assembling the latching element 100 to the main body 200 of mobile phone, the two ends of the shaft 13 are respectively inserted into the corresponding shaft hole 2331, thereby completing the assembly of the latching element 100 to the mobile phone.

When assembling of the SIM card 300 to the mobile phone, firstly, the user places a finger on the concave portion 234 of the mobile phone and pushes the locking portion 112 away from the concave portion 234 of the main body 200. Then, the locking portion 112 is pushed so as to force the latching element 100 to rotate to open relative to the main body 200 about the shaft 13. After that, the SIM card 300 is placed into the cavity 210. When the SIM card 300 is completely placed into the cavity 210, the latching element 100 rotatably covers the SIM card 300.

The steps of removing the SIM card 300 from the mobile phone are the reverse of the placing method shown above.

Figure 3:
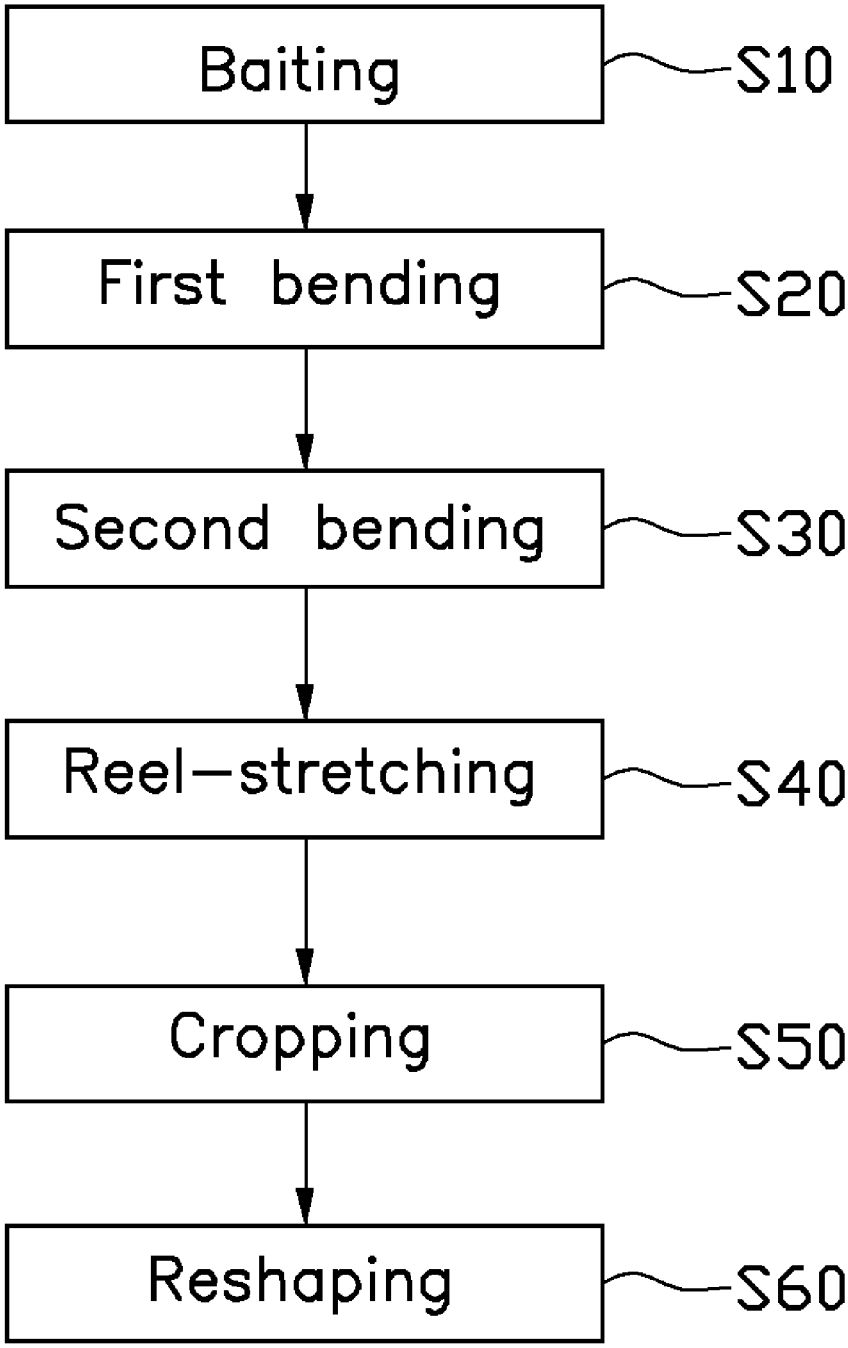
FIG. 3 is a flow chart of a method of manufacturing the latching element shown in FIG. 2.

FIG. 3 schematically depicts the steps of an exemplary method for manufacturing the latching element 100.

Figure 4:
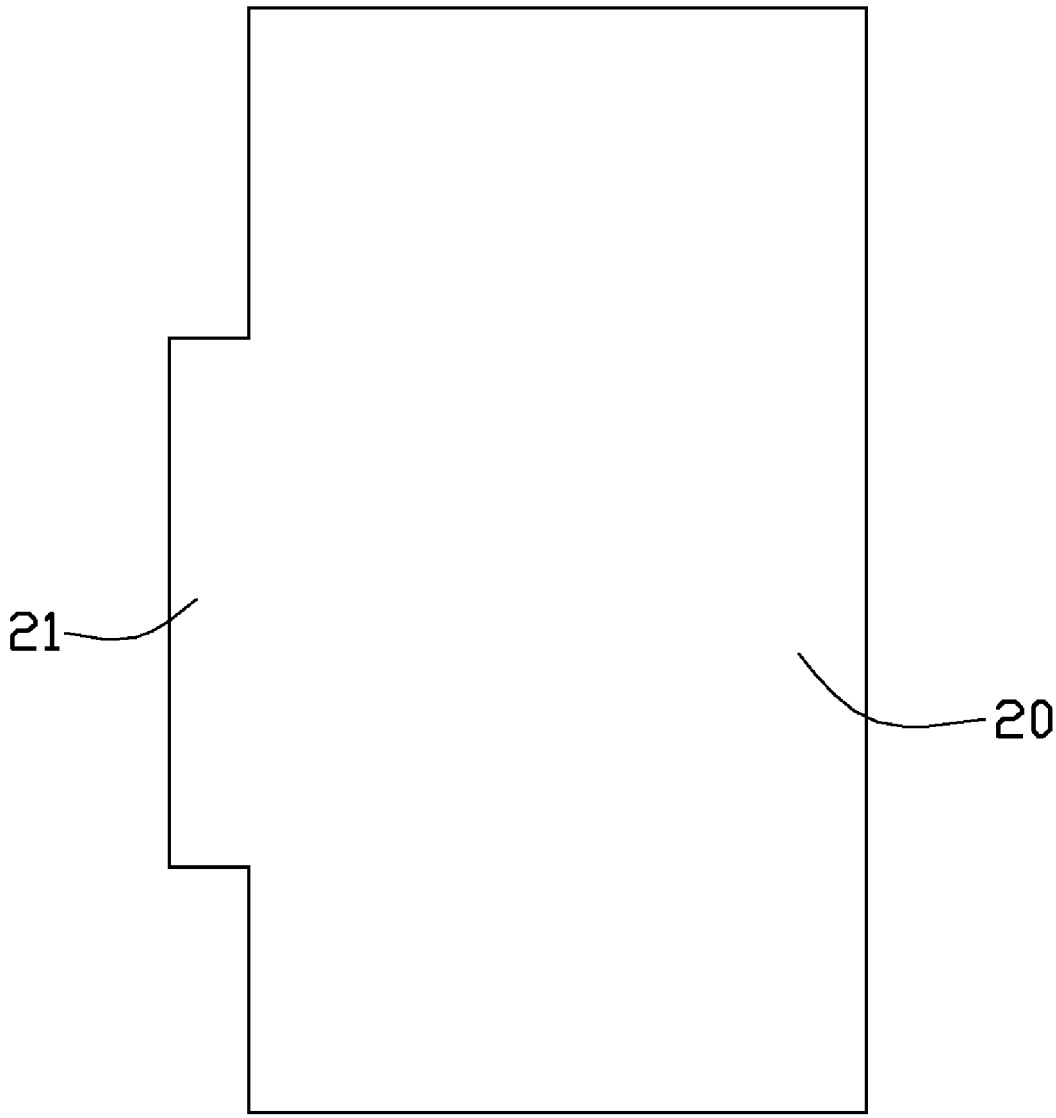
FIG. 4 is a top plan view of a metal plate for making the latching element.

Referring to FIG. 4, a metal plate 20 is provided. In Step S10, the metal plate 20 is cut by the laser to form a predetermined shape with an extending portion 21. The material of the metal plate 20 is preferably 1Cr17Ni7 or SUS301-H. The yield strength of the material is typically no more than about 80 kg/cm$^2$, and the elongation rate of the metal should not be less than about 5%. Preferably, the thickness of the metal is in a range of about 0.1 mm to 0.3 mm.

Figure 5:
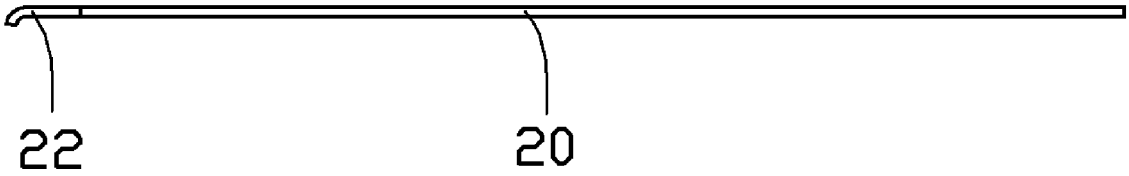
FIG. 5 is a side view showing the effect of the first bending of the metal plate.

Referring to FIG. 5, in step S20, the extending portion 21 undergoes a first bending process to form an arcuate bent portion 22 at one end. In the first bending process, the width of the extending portion 21, about ¼~⅙ of a circumferential length of the predetermined shaft.

Figure 6:
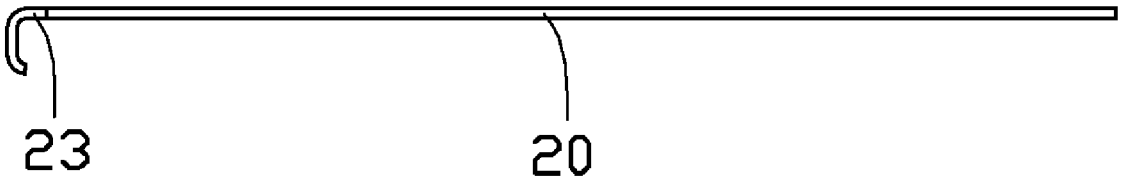
FIG. 6 is a side view showing the effect of the second bending of the metal plate.

Referring to FIG. 6, in step S30, the bent portion 22 undergoes a second bending process to form a curl portion 23. In the second bending process, the curl portion 23 and the metal plate 20 form an angle of 70°~110°; and the length of the curl portion 23 is approximately equal to the circumference of the shaft 13.

Figure 7:
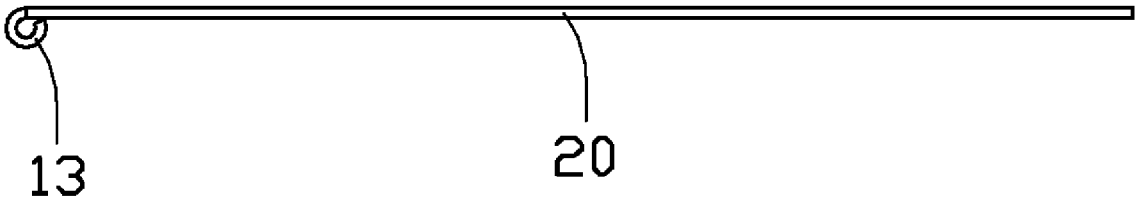
FIG. 7 is a side view showing the effect of the reel-stretching of the metal plate.
Figure 8:
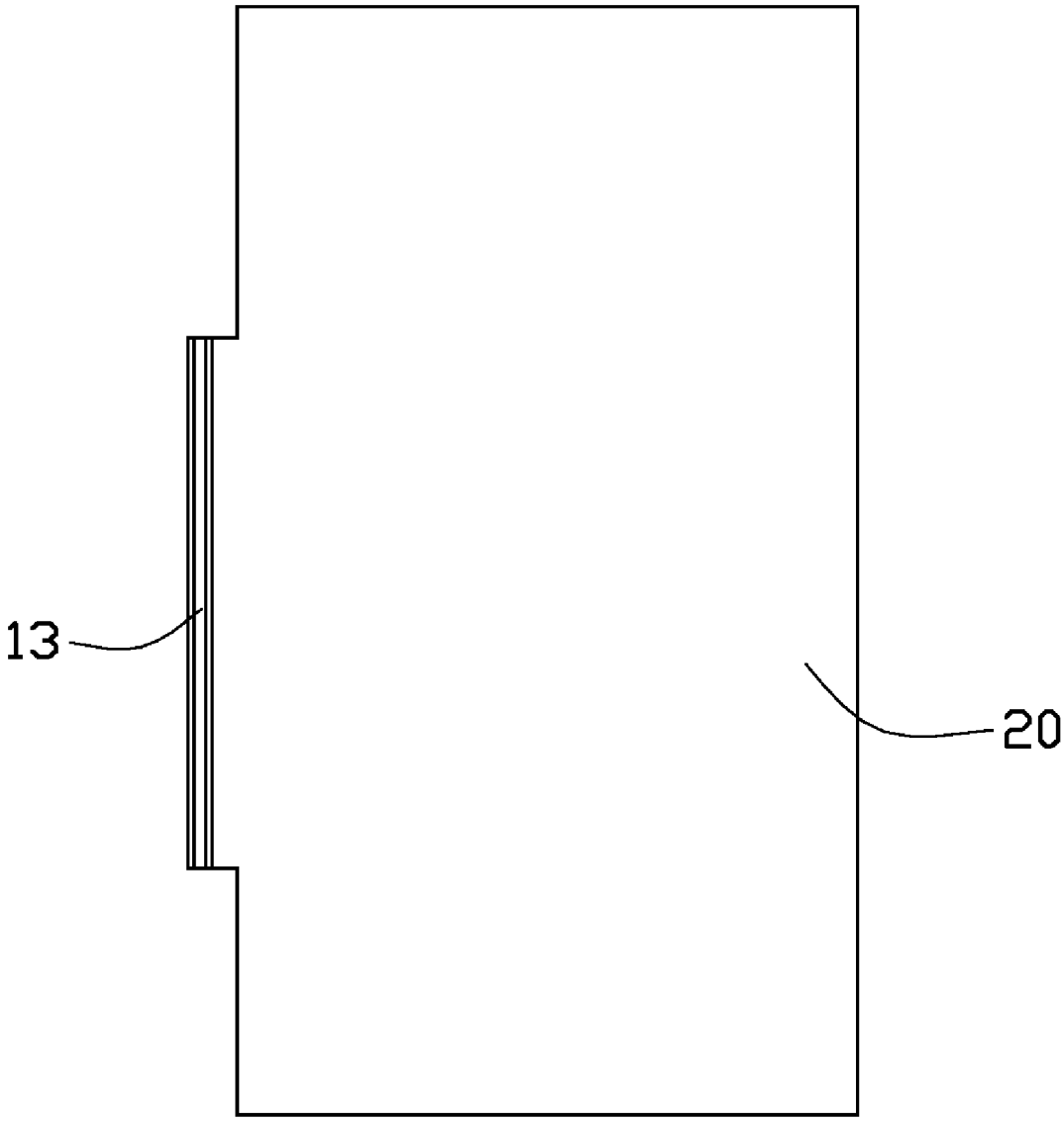
FIG. 8 is a top plan view of the metal plate after the step of reel-stretching.
Figure 9:
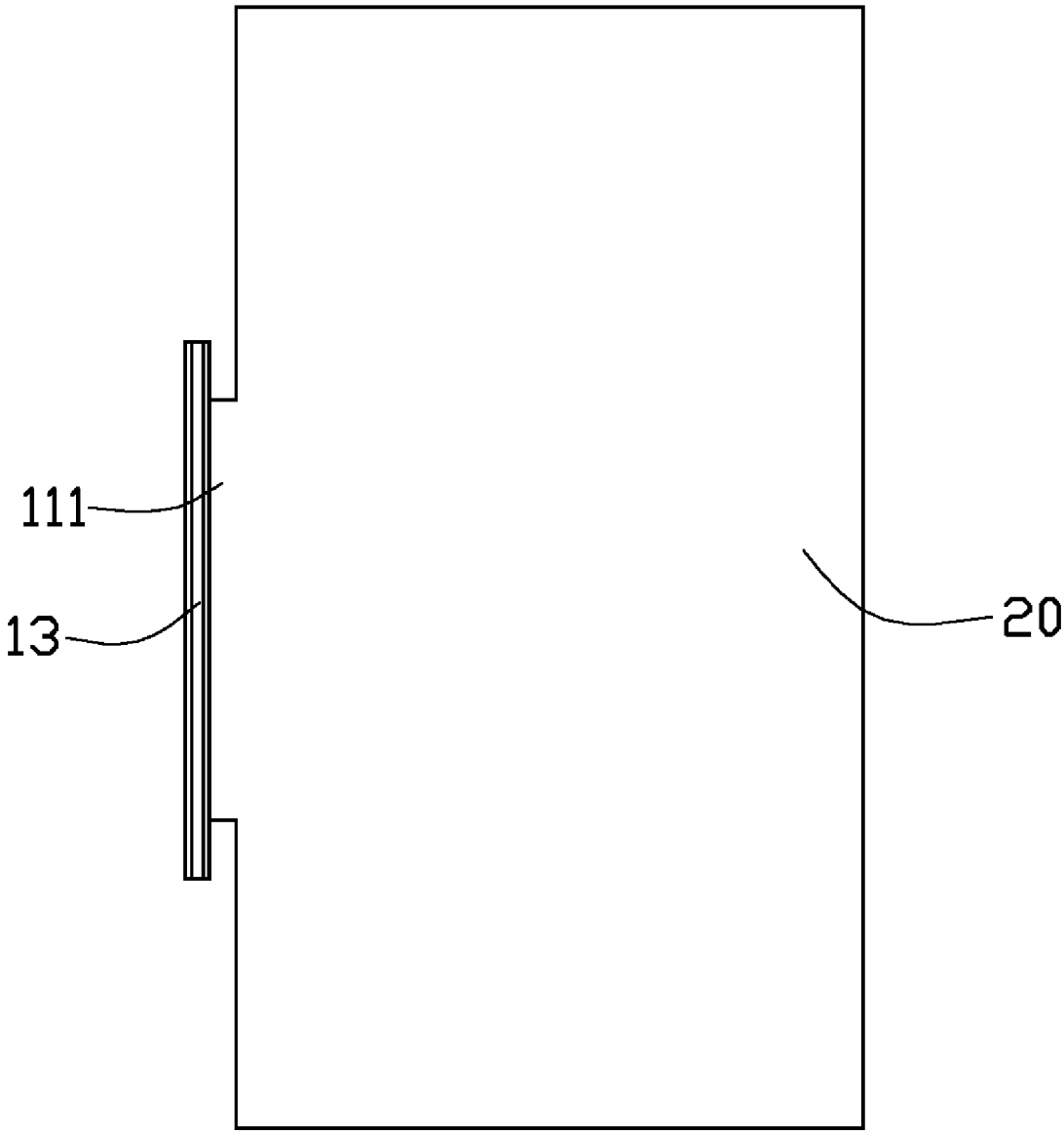
FIG. 9 is a top plan view showing the effect of the step of cropping.
Figure 10:
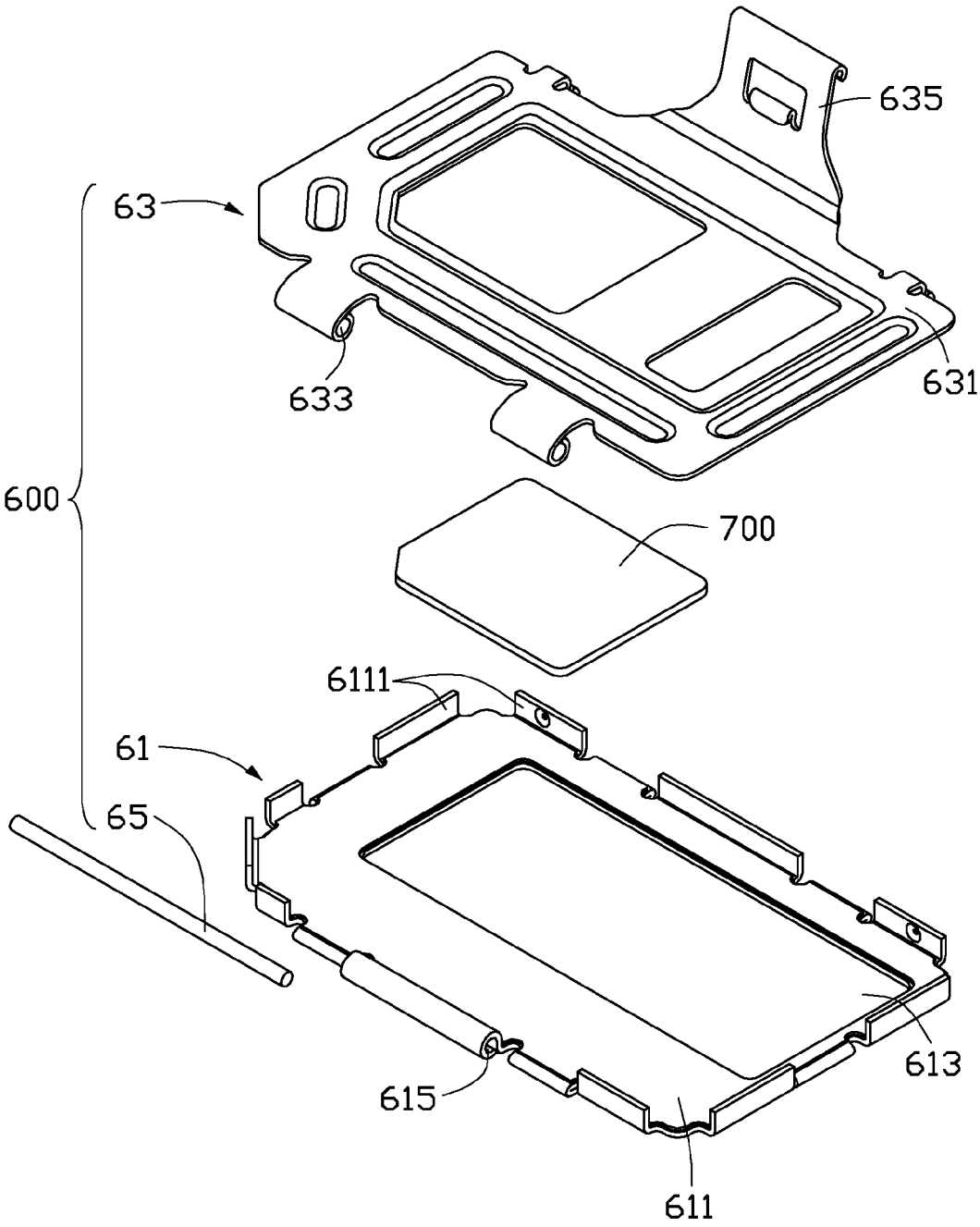
FIG. 10 (RELATED ART)
FIG. 10 is an exploded, isometric view of a conventional chip card holder.
Figure 11:
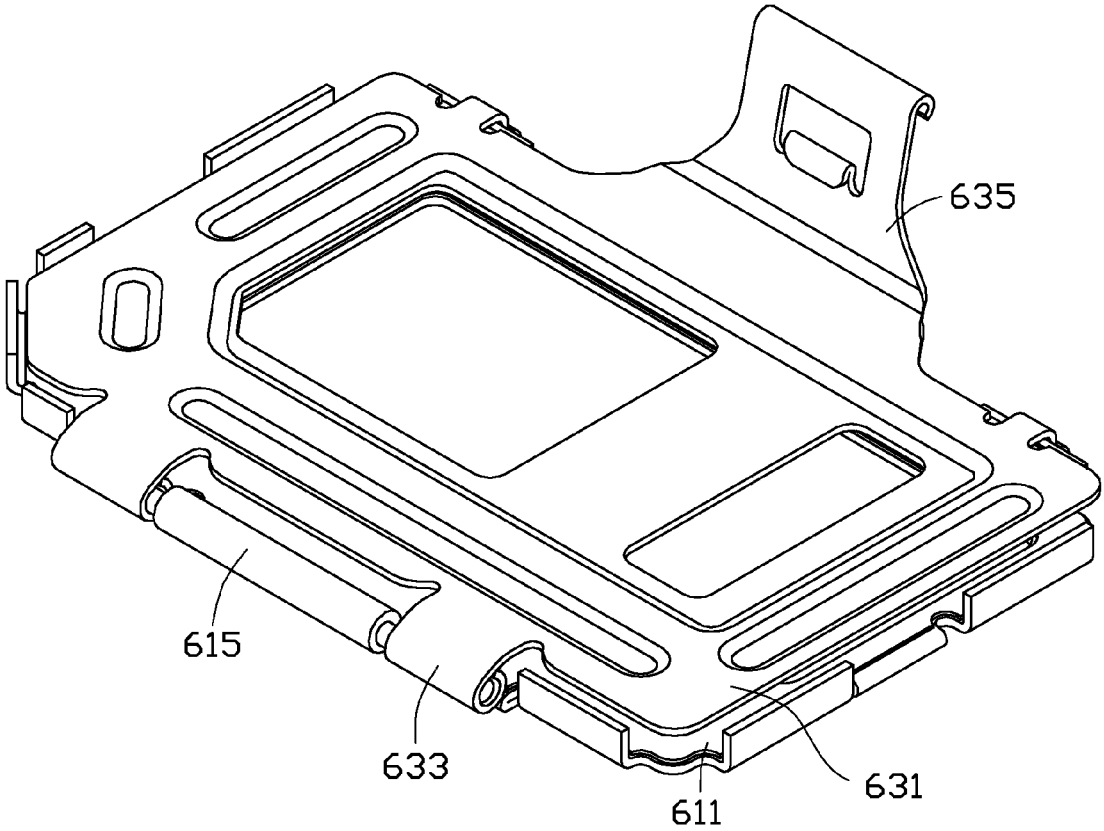
FIG. 11 (RELATED ART)
FIG. 11 is an assembled view of the chip card holder.

Referring to FIGS. 7 and 8, in step S40, the curl portion 23 is reel-stretched to form a shaft 13, the curl portion 23 is pressed gradually to prevent it from cracking Referring to FIG. 9, in step S50, the metal plate 20 is cropped to form a connecting portion 111. The connecting portion 111 is spaced from the metal plate 20. The connecting shaft 13 is longer than the connecting portion 111.

The shaft 13 is reshaped to have enough roundness and the metal plate 10 is punched to form other protrusions or defines holes required to form the latching element 100.

It is to be understood that the process of punching of protrusions or holes is not limited to during reshaping, but could be carry out in any process before or afterwards.

It is to be understood, however, that even though numerous characteristics and advantages of the exemplary disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A latching element comprising:

a main section including a first end and a second end opposite to the first end;

a connecting portion formed on the first end of the main section; and a locking portion formed on the second end of the main section;

wherein the latching element, including the connecting portion thereof, is formed from a single plate, the connecting portion being bent to form a hollow shaft.

2. The latching element of claim 1, wherein the shaft is formed on the edge of the connecting portion by reel-stretching.

3. The latching element of claim 2, wherein the latching element is made of metal.

4. A portable electronic device, comprising:

a main body defining a cavity to receive a surface card therein;

a latching element configured to retain the surface card in the cavity, the latching element having a main section with a first end and a second end opposite to the first end, a connecting portion formed on the edge of the first end, a locking portion formed on the edge of the second end, the latching element, including the connecting portion thereof, being formed from a single plate, the connecting portion being bent to form a hollow shaft.

5. The portable electronic device of claim 4, wherein the shaft is formed on the connecting portion by reel-stretching.

6. The portable electronic device of claim 4, wherein the latching element is made of metal.

7. The portable electronic device of claim 4, wherein the main body has a bottom surface and two mounting portions extending upward from the bottom surface to receive the shaft therein.

8. The portable electronic device of claim 7, wherein each mounting portion defines a shaft hole to receive the shaft.

9. The portable electronic device of claim 8, wherein each mounting portion defines an opening, each opening communicates with the corresponding shaft hole, and the shaft is inserted into the shaft holes through the openings.

10. The portable electronic device of the claim 4, wherein the locking portion is formed by punching the edge of the second end of the main section.

11. The portable electronic device of the claim 4, wherein the cavity is cooperatively surrounded by four sidewalls, a concavity being defined in one of the sidewalls.

* * * * *